US007888299B2

(12) United States Patent
Milner et al.

(10) Patent No.: US 7,888,299 B2
(45) Date of Patent: Feb. 15, 2011

(54) EXTENDED DRAIN, THERMALLY STABLE, GEAR OIL FORMULATIONS

(75) Inventors: Jeffrey L. Milner, Chesterfield, VA (US); Masao Seki, Tokyo (JP); Roger M. Sheets, Glen Allen, VA (US); Kenji Yatsunami, Tokyo (JP)

(73) Assignee: Afton Chemical Japan Corp., Tokyo (JP)

( * ) Notice: Subject to any disclaimer, the term of this patent is extended or adjusted under 35 U.S.C. 154(b) by 943 days.

(21) Appl. No.: 10/756,711

(22) Filed: Jan. 13, 2004

(65) Prior Publication Data

US 2004/0147410 A1 Jul. 29, 2004

(30) Foreign Application Priority Data

Jan. 15, 2003 (JP) ..... 2003-007272

(51) Int. Cl.

| | |
|---|---|
| ***C10M 135/22*** | (2006.01) |
| ***C10M 139/00*** | (2006.01) |
| ***C10M 169/04*** | (2006.01) |
| ***C10M 137/10*** | (2006.01) |
| ***C10M 159/12*** | (2006.01) |

(52) U.S. Cl. ..... 508/569; 508/195; 508/433; 508/436; 508/192; 508/189

(58) Field of Classification Search ..... 508/195, 508/569, 433, 436, 192, 189
See application file for complete search history.

(56) References Cited

U.S. PATENT DOCUMENTS

| | | | |
|---|---|---|---|
| 2,284,409 | A | 5/1942 | Erath |
| 2,284,410 | A | 5/1942 | Farmer |
| 2,459,112 | A | 1/1949 | Oberright |
| 2,693,448 | A | 11/1954 | Landis et al. |
| 2,908,649 | A | 10/1959 | Cunningham et al. |
| 2,945,749 | A | 7/1960 | Andress, Jr. |
| 2,962,442 | A | 11/1960 | Andress |
| 2,984,550 | A | 5/1961 | Chamot |
| 3,036,003 | A | 5/1962 | Verdol |
| 3,087,936 | A | 4/1963 | LeSuer |
| 3,163,603 | A | 12/1964 | LeSuer |
| 3,166,516 | A | 1/1965 | Kirkpatrick |
| 3,172,892 | A | 3/1965 | LeSuer et al. |
| 3,184,474 | A | 5/1965 | Catto |
| 3,202,678 | A | 8/1965 | Stuart et al. |
| 3,215,707 | A | 11/1965 | Rense |
| 3,216,936 | A | 11/1965 | LeSuer |
| 3,219,666 | A | 11/1965 | Norman et al. |
| 3,235,498 | A | 2/1966 | Waldmann |
| 3,235,499 | A | 2/1966 | Waldmann |
| 3,235,501 | A | 2/1966 | Waldmann |
| 3,235,502 | A | 2/1966 | Waldmann |
| 3,236,770 | A | 2/1966 | Matson |
| 3,254,025 | A | 5/1966 | LeSuer |
| 3,271,310 | A | 9/1966 | LeSuer |
| 3,272,746 | A | 9/1966 | LeSuer et al. |
| 3,281,357 | A | 10/1966 | Vogel |
| 3,281,428 | A | 10/1966 | LeSuer |
| 3,282,955 | A | 11/1966 | LeSuer |
| 3,306,908 | A | 2/1967 | LeSuer |
| 3,311,558 | A | 3/1967 | Prizer et al. |
| 3,316,177 | A | 4/1967 | Dorer, Jr. |
| 3,329,658 | A | 7/1967 | Fields |
| 3,338,832 | A | 8/1967 | LeSuer |
| 3,340,281 | A | 9/1967 | Brannen, Jr. |
| 3,341,542 | A | 9/1967 | LeSuer et al. |
| 3,344,069 | A | 9/1967 | Stuebe |
| 3,346,493 | A | 10/1967 | LeSuer |
| 3,368,972 | A | 2/1968 | Otto |
| 3,381,022 | A | 4/1968 | LeSuer |
| RE26,433 | E | 8/1968 | LeSuer |
| 3,399,141 | A | 8/1968 | Clemens |
| 3,413,347 | A | 11/1968 | Worrel |
| 3,415,750 | A | 12/1968 | Anzenberger |
| 3,433,744 | A | 3/1969 | LeSuer |
| 3,442,808 | A | 5/1969 | Traise et al. |
| 3,444,170 | A | 5/1969 | Norman et al. |
| 3,448,047 | A | 6/1969 | Traise et al. |

(Continued)

FOREIGN PATENT DOCUMENTS

EP 0434464 A1 * 12/1990

(Continued)

OTHER PUBLICATIONS

AMSOIL Synthetic Lubricants, Worlds Best Oil, (2005); retrieved from the World Wide Web Aug. 8, 2006: http:www.worldsbestoil.ca/agl-80w90-synthetic-gear-lube.php.*

(Continued)

*Primary Examiner*—Anhtuan T Nguyen
*Assistant Examiner*—Amy Lang
(74) *Attorney, Agent, or Firm*—Luedeka, Neely & Graham, P.C.

(57) ABSTRACT

In its broadest concept, the present invention relates to an improved gear oil comprising:

a) a base oil having a viscosity range of 4 to 32 cSt at 100° C.;

b) a maximum level of hydrocarbyl polysulfide with a minimum level of active S species;

c) a dihydrocarbyl dithiophosphate ester or salt; and d) a dihydrocarbyl (mono)thiophosphate amine salt, essentially free of phosphite.

10 Claims, No Drawings

U.S. PATENT DOCUMENTS

| | | | | |
|---|---|---|---|---|
| 3,448,048 | A | | 6/1969 | LeSuer et al. |
| 3,448,049 | A | | 6/1969 | Preuss et al. |
| 3,449,250 | A | | 6/1969 | Fields |
| 3,451,933 | A | | 6/1969 | Leister |
| 3,454,497 | A | | 7/1969 | Wittner |
| 3,454,607 | A | | 7/1969 | LeSuer et al. |
| 3,459,661 | A | | 8/1969 | Schlobohm |
| 3,467,668 | A | | 9/1969 | Gruber et al. |
| 3,493,520 | A | | 2/1970 | Verdol et al. |
| 3,519,565 | A | | 7/1970 | Coleman |
| 3,522,179 | A | | 7/1970 | LeSuer |
| 3,533,945 | A | | 10/1970 | Vogel |
| 3,539,633 | A | | 11/1970 | Piasek et al. |
| 3,541,012 | A | | 11/1970 | Stuebe |
| 3,542,678 | A | | 11/1970 | Bork |
| 3,547,101 | A | | 12/1970 | Rosauer |
| 3,558,743 | A | | 1/1971 | Verdol et al. |
| 3,576,743 | A | | 4/1971 | Widmer |
| 3,586,629 | A | | 6/1971 | Otto et al. |
| 3,591,598 | A | | 7/1971 | Traise et al. |
| 3,600,372 | A | | 8/1971 | Udehofen et al. |
| 3,623,983 | A | | 11/1971 | Pattenden et al. |
| 3,630,904 | A | | 12/1971 | Musser et al. |
| 3,632,510 | A | | 1/1972 | LeSuer |
| 3,632,511 | A | | 1/1972 | Liao |
| 3,634,515 | A | | 1/1972 | Piasek |
| 3,649,229 | A | | 3/1972 | Otto |
| 3,658,836 | A | | 4/1972 | Vineyard |
| 3,666,730 | A | | 5/1972 | Coleman |
| 3,687,849 | A | | 8/1972 | Abbott |
| 3,697,428 | A | | 10/1972 | Meinhardt et al. |
| 3,697,574 | A | | 10/1972 | Piasek et al. |
| 3,702,300 | A | | 11/1972 | Coleman |
| 3,703,536 | A | | 11/1972 | Piasek et al. |
| 3,704,308 | A | | 11/1972 | Piasek et al. |
| 3,718,663 | A | | 2/1973 | Piasek et al. |
| 3,725,277 | A | | 4/1973 | Worrel |
| 3,725,441 | A | | 4/1973 | Murphy |
| 3,725,480 | A | | 4/1973 | Traise et al. |
| 3,726,882 | A | | 4/1973 | Traise et al. |
| 3,736,357 | A | | 5/1973 | Piasek et al. |
| 3,751,365 | A | | 8/1973 | Piasek et al. |
| 3,756,953 | A | | 9/1973 | Piasek et al. |
| 3,793,202 | A | | 2/1974 | Piasek et al. |
| 3,798,165 | A | | 3/1974 | Piasek et al. |
| 3,798,247 | A | | 3/1974 | Piasek et al. |
| 3,803,039 | A | | 4/1974 | Piasek et al. |
| 3,868,330 | A | | 2/1975 | Meinhardt et al. |
| 3,872,019 | A | | 3/1975 | Culbertson et al. |
| 3,904,595 | A | | 9/1975 | Plonsker et al. |
| 3,948,800 | A | | 4/1976 | Meinhardt |
| 3,957,746 | A | | 5/1976 | Malec |
| 3,980,569 | A | | 9/1976 | Pindar et al. |
| 3,985,802 | A | | 10/1976 | Piasek et al. |
| 3,997,454 | A | | 12/1976 | Adams |
| 4,006,089 | A | | 2/1977 | Chibnik |
| 4,011,380 | A | | 3/1977 | West et al. |
| 4,025,451 | A | | 5/1977 | Plonsker et al. |
| 4,058,468 | A | | 11/1977 | Malec |
| 4,083,699 | A | | 4/1978 | Chibnik |
| 4,090,854 | A | | 5/1978 | Davis |
| 4,234,435 | A | | 11/1980 | Meinhardt et al. |
| 4,282,153 | A | * | 8/1981 | Minn ..... 549/221 |
| 4,354,950 | A | | 10/1982 | Hammond et al. |
| 4,455,243 | A | | 6/1984 | Liston |
| 4,485,023 | A | | 11/1984 | Serres et al. |
| 4,652,387 | A | | 3/1987 | Andress, Jr. et al. |
| 5,034,018 | A | | 7/1991 | Gutierrez et al. |
| 5,171,466 | A | * | 12/1992 | Korosec ..... 508/188 |
| 5,242,613 | A | * | 9/1993 | Ozbalik et al. ..... 508/324 |
| 5,254,272 | A | * | 10/1993 | Walters et al. ..... 508/294 |
| 5,498,355 | A | * | 3/1996 | Perozzi et al. ..... 508/194 |
| 5,534,173 | A | | 7/1996 | Faber et al. |
| 5,942,470 | A | | 8/1999 | Norman et al. |
| 6,133,207 | A | * | 10/2000 | Milner et al. ..... 508/436 |
| 6,689,723 | B2 | * | 2/2004 | Sullivan et al. ..... 508/185 |
| 2002/0032293 | A1 | * | 3/2002 | Bryant et al. ..... 526/260 |
| 2003/0171222 | A1 | * | 9/2003 | Sullivan et al. ..... 508/192 |
| 2010/0137173 | A1 | * | 6/2010 | Sheets et al. ..... 508/192 |

FOREIGN PATENT DOCUMENTS

| | | | | |
|---|---|---|---|---|
| EP | 0744456 | A2 | * | 2/1996 |
| EP | 0744456 | | | 11/1996 |
| EP | 744456 | A2 | * | 11/1996 |
| EP | 744456 | A2 | | 4/2007 |
| GB | 801151 | | | 9/1958 |
| GB | 1 306 529 | | | 2/1973 |
| JP | 2001-311090 | | | 4/2000 |
| JP | 2000328084AA | | | 11/2000 |
| JP | 2001-181663 | A | | 3/2001 |
| JP | 2001181663 | | | 7/2001 |
| JP | 2001-311090 | A | | 9/2001 |
| WO | 91/09922 | | | 7/1991 |

OTHER PUBLICATIONS

Atofina, "Sulfer Additives for Lubricants" [online], Mar. 15, 2000, http://www.atofina.com/Service/Tele/DownLoad/Grp1/All_about_TPS_vep.pdf.

Atofina Chemicals; TPS Sulfur Additives for Lubricants; Mar. 2000, (30 pages).

* cited by examiner

EXTENDED DRAIN, THERMALLY STABLE, GEAR OIL FORMULATIONS

TECHNICAL FIELD

This invention relates to a gear oil composition that balances both manual transmission and final drive automotive gear requirements. The present composition provides low odor, acceptable GL-4 and GL-5 performance, high temperature oxidation stability, antiwear protection, copper passivation and satisfactory synchronizer performance without requiring the use of metal detergents.

BACKGROUND OF THE INVENTION

This invention relates to gear oils for use in heavy duty (HD) axle and transmission applications. More particularly, this invention relates to extended drain, thermally stable gear oils.

Gear oils are different from other lubricants as the conditions experienced in manual transmissions and axles are extreme. One major difference in the composition of gear oils from other lubricants is the presence of extreme pressure (EP) agents. These EP agents often contain high levels of sulfur which are unacceptable to other lubricants due to oxidation problems.

There are also different performance requirements for specific gear oils directed for use in manual transmissions and final reduction gear sets. For example, final reduction gear sets require higher EP operation conditions. There presently exists a need for a dual-purpose gear oil for both manual transmissions and final reduction gear sets to economize maintenance.

Japanese laid-open patent (JP 328084) "Hino" describes an automotive gear oil composition for both manual transmissions and final reduction gear sets. Hino discloses three specific antiwear additives, including phosphites, along with an alkyl-t-butyl trisulfide EP additive. While alkyl-t-butyl trisulfides are thermally stable, they lack sufficient EP performance and do not provide acceptable GL-5 shock performance without going to very high treat rates or adding additional EP components. Furthermore, the phosphites can react with trisulfides to form undesirable odorous mercaptan by-products. Finally, phosphites do not provide sufficient break-in performance for high temperature wear protection.

SUMMARY OF THE INVENTION

In its broadest concept, the present invention relates to an improved gear oil comprising:

a) a base oil having a viscosity range of 4 to 32 cSt at 100° C.;

b) a hydrocarbyl polysulfide with a minimum level of active S species;

c) a dihydrocarbyl dithiophosphate ester or salt; and d) a dihydrocarbyl (mono)thiophosphate amine salt, essentially free of phosphite.

The present invention provides the following advantages over the known art:

(1) no metal detergents needed to balance axle and synchronizer performance;

(2) good thermal stability (ISOT) and clean gear performance (L-60-1);

(3) low odor formulations;

(4) low wear in high temperature axle and bearing test; and (5) minimizes the concentration of the EP additive (alkyl polysulfide) without sacrificing the GL-5 performance capabilities.

DETAILED DESCRIPTION OF THE PREFERRED EMBODIMENTS

As used herein and in the claims, the term "percent by weight" means the percentage the recited component represents to the weight of the entire composition.

Component A: Base Oils

Generally, the base oils useful in this invention may be formed from natural (e.g. mineral or vegetable oils) or synthetic base oils, or blends thereof. Suitable mineral oils include those of appropriate viscosity refined from crude oil of any source. Standard refinery operations may be used in processing the mineral oil. Among the general types of petroleum oils useful in the compositions of this invention are bright stocks, residual oils, hydrocracked base stocks, and solvent extracted naphthenic oils. Such oils and blends of them are produced by a number of conventional techniques that are widely known by those skilled in the art.

Among the suitable synthetic oils are homo- and interpolymers of $C_2$-$C_{12}$ olefins, carboxylic-type-acid esters of both monoalcohols and polyols, polyethers, silicones, polyglycols, silicates, alkylated aromatics, carbonates, thiocarbonates, orthoformates, and halogenated hydrocarbons. Representative of such oils are homo- and interpolymers of $C_2$-$C_2$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls).

Alkylene oxide polymers and interpolymers and derivatives thereof where the terminal hydroxyl groups have been modified by esterification, etherification, etc., constitute a class of synthetic oils useful herein. These are exemplified by the oils prepared through polymerization of alkylene oxides such as ethylene oxide or propylene oxide, and the alkyl and aryl ethers of these polyoxyalkylene polymers, for example, methyl polyisopropylene glycol ether having an average molecular weight of 1,000 and the diphenyl ethers of polyethylene glycol having a molecular weight of 500-1,000 are useful in this invention. The diethyl ethers of polypropylene glycol having a molecular weight of 1,000-1,500 or mono- and poly-carboxylic esters thereof are also useful.

Another suitable class of synthetic oils comprises the esters of dicarboxylic acids (e.g., phthalic acid, linoleic acid dimer) with a variety of alcohols such as but not limited to butyl alcohol, hexyl alcohol, and dodecyl alcohol. Specific examples of these esters include dibutyl adipate, dodecyl adipate, di-n-hexyl fumarate, and the complex ester formed by reacting one mole of sebacate acid with two moles of tetraethylene glycol and two moles of 2-ethylhexanoic acid.

Other esters which may be used include those made from $C_3$-$C_{18}$ monocarboxylic acids and polyols and polyol ethers such as neopentyl glycol, trimethylolpropane, pentaerythritol and dipentaeryfintol. Trimethylol propane tripelargonate, pentaeryibritol tetracaproate, and the polyesters derived from a $C_4$-$C_{14}$ dicarboxylic-type acid and one or more aliphatic dihydric $C_3$-$C_{12}$ alcohols such as those derived from azelaic acid or sebacic acid and 2,2,4-trimethyl-1,6-hexanediol serve as examples.

Silicon-based oils such as the polyalkyl-, polyaryl-, polyalkoxy-, or polyaryloxy-siloxane oils and silicate oils comprise another class of synthetic lubricants, (e.g., tetraethyl silicate, tetraisopropyl silicate, and poly(methyl-phenyl)siloxanes) useful in the gear oil according to the invention.

Also useful as base oils or as components of base oils are hydrogenated or unhydrogenated liquid oligomers of $C_6$-$C_{16}$ alpha-olefins, such as hydrogenated or unhydrogenated oligomers formed from 1-decene.

Typical vegetable oils that may be used as base oils or as components of the base oils include castor oil, olive oil, peanut oil, corn oil, soybean oil, linseed oil, and the like. Such oils may be partially or fully hydrogenated, if desired.

According to the present invention, the base oil should have a viscosity that meets at least the viscometric requirements and a flash point temperature such that it will not contribute to the breakdown of the performance of the finished oil used in transmission, gear or axle applications. Thus, the kinematic viscosity of a useful base oil at 100° C. will preferably range from about 4.0 to about 32.0 cSt.

Component B

The present composition contains Component B containing a hydrocarbyl polysulfide with a sulfur activity of greater than about 125 mg in the Copper Corrosion Test (CCT). Active EP as measured by the CCT test (described below), identifies an EP additive based on its corrosivity to copper. This is a measure of the active sulfur present in the EP additive which enables the EP additive to effectively form a protective film necessary to pass in EP shock tests. Said protective film is required for GL-5 shock performance. Chemical structures of the EP additives impact the copper corrosion weight loss in the Indiana Stirring and Oxidation Test ("ISOT") bench test (also known as Japanese Industrial Standard (JIS) K-2514 "Testing Methods for Oxidation Stability of Lubrication Oils"). Low copper weight loss in ISOT will translate to prolong life in transmission applications, where copper protection is needed. The combination of high CCT from the EP additive and low ISOT copper weight loss assists in defining the EP additive that provides the desired balance between EP and copper passivity. EP additives that are excessively aggressive to copper in the ISOT bench test can be detrimental to the copper components in manual transmissions. Aggressive EP additives can require the addition of detergent to improve manual transmission performance.

In a preferred embodiment, the hydrocarbyl polysulfide is an alkyl polysulfide. In a further preferred embodiment, the alkyl polysulfide is a mixture of tetra-, tri- and/or di-sulfide such that the sulfur activity is greater than 125 mg in the CCT bench test. This allows for sufficient EP performance without having very high treat rates or the addition of other EP components. The hydrocarbyl portion of Component B may be selected from the group consisting of: aliphatic hydrocarbon groups with straight or branched carbon chain of about 2 to about 15 carbon atoms, saturated or unsaturated, alkyl groups, alkenyl groups and aromatic hydrocarbon groups. Specifically, the hydrocarbyl portion may include, without limitation, ethyl, 1-propyl, 2-propyl, n-butyl, t-butyl, nonyl, propenyl, butenyl, benzyl, phenyl, etc.

Hydrocarbyl polysulfides may include, without limitation, dicyclohexyl polysulfide, diphenyl polysulfide, dibenzyl polysulfide, dinonyl polysulfide, and mixtures of di-t-butyl polysulfides such as mixtures of di-t-butyl trisulfide, di-t-butyl tetrasulfide and di-t-butyl pentasulfide.

The most preferred Component B is a di-t-butyl polysulfide.

The weight percentage of Component B is preferably less than 3.5 percent and most preferably less than 2.5 percent based on the total weight of the gear oil. The preferred level of Component B should contribute less than 1.3 percent sulfur to be finished oil. This balances the EP protection with copper passivation. The preferred minimum level of active sulfur species is a level sufficient to provide a sulfur activity of greater than about 125 mg in the CCT.

Component C

The present composition contains a Component C containing a dihydrocarbyl dithiophosphate ester or salt. The hydrocarbyl portion of Component C may be selected from the group consisting of: aliphatic hydrocarbon groups with straight or branched carbon chain of about 2 to about 12 carbon atoms, saturated or unsaturated, alkyl groups, alkenyl groups and aromatic hydrocarbon groups. Specifically, the hydrocarbyl portion may, independently, be ethyl, 1-propyl, 2-propyl, n-butyl, t-butyl, nonyl, propenyl, butenyl, benzyl, phenyl, etc. A preferred embodiment is as follows:

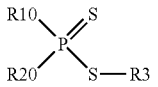

wherein $R^1$, $R^2$ and $R^3$ can be independent alkyl or aromatic groups. $R^1$ and $R^2$ can be the same or mixtures derived from several different alcohols.

The most preferred Component C is the product resulting from the mixture or reaction of dicyclopentadiene and dialkyldithiophosphoric acid.

The weight percentage of Component C is preferably about 0.1 percent to about 6 percent and most preferably between 0.1 percent and 2.5 percent, based on the total weight of the gear oil.

Component D

The present composition contains a Component D containing a dihydrocarbyl (mono)thiophosphate amine salt. Component D should be essentially free of phosphites. Components essentially free of phosphites should have no peak in the 8-7 ppm region of the 31P nmr spectra (QE 300 nmr with a detection level better than 5 ppm).

The hydrocarbyl portion of Component D may be selected from the group consisting of: aliphatic hydrocarbon groups with straight or branched carbon chain of about 2 to about 24 carbon atoms, saturated or unsaturated, alkyl groups, alkenyl groups and aromatic hydrocarbon groups. Specifically, the hydrocarbyl portion may, independently, be ethyl, 1-propyl, 2-propyl, n-butyl, t-butyl, nonyl, propenyl, butenyl, benzyl, phenyl, etc.

In one embodiment, hydrocarbyl amines are useful in preparing the amine salts of the present invention. These amines may be primary hydrocarbyl amines containing from about 4 to about 30 carbon atoms in the hydrocarbyl group, and more preferably from about 8 to about 20 carbon atoms in the hydrocarbyl group. The hydrocarbyl group may be saturated or unsaturated. Representative examples of primary saturated amines are those known as aliphatic primary fatty amines and commercially known as "Armeeno" primary amines (products available from Akzo Nobel Chemicals, Chicago, Ill.). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These Armeen primary amines are available in both distilled and technical grades. While the distilled grade will provide a purer reaction product, the desirable amides and imides will form in reactions with the amines of technical grade. Also suitable are mixed fatty amines such as Akzo's Armeen-C, Armeen-O, Armeen-OL, Armeen-T, Armeen-HT, Armeen-S and Armeen-SD.

In another preferred embodiment, the amine salts of the composition of this invention are those derived from tertiary-aliphatic primary amines having at least about 4 carbon atoms in the alkyl group. For the most part, they are derived from alkyl amines having a total of less than about 30 carbon atoms in the alkyl group.

Usually the tertiary aliphatic primary amines are monoamines represented by the formula

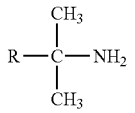

wherein R is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}$-$C_{14}$ tertiary alkyl primary amines and "Primene JM-T" which is a similar mixture of $C_{18}$-$C_{22}$ tertiary alkyl primary amines (both are available from Rohm and Haas Company). The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are quite useful. Thus, the R' and R" groups may contain one or more olefinic unsaturation depending on the length of the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

Secondary amines include dialkylamines having two of the above alkyl groups including such commercial fatty secondary amines as Armeen-2C and Armeen-2HT, and also mixed dialkylamines where R' is a fatty amine and R" may be a lower alkyl group (1-9 carbon atoms) such as methyl, ethyl, n-propyl, i-propyl, butyl, etc., or R" may be an alkyl group bearing other non-reactive or polar substituents (CN, alkyl, carbalkoxy, amide, ether, thioether, halo, sulfoxide, sulfone) such that the essentially hydrocarbon character of the radical is not destroyed. The fatty polyamine diamines include mono- or dialkyl, symmetrical or asymmetrical ethylene diamines, propane diamines (1,2, or 1,3), and polyamine analogs of the above. Suitable commercial fatty polyamines are available under the Duomeen® tradename from Akzo Nobel. Suitable polyamines include Duomeen C (N-coco-1,3-diaminopropane), Duomeen S (N-soyaalkyl trimethylenediamine), Duomeen T (N-tallow-1,3-diaminopropane), or Duomeen OL (N-oleyl-1,3-diaminopropane).

The most preferred Component D is the product resulting from the mixture or reaction of dibutylhydrogen phosphite, sulfur and an amine or mixture thereof.

The weight percentage of Component D is preferably about 0.01 percent to about 1.0 percent, based on the total weight of the gear oil.

Other Components

The composition of the present invention may further contain one or more of the following compounds.

One type of copper corrosion inhibitors that may be used in the practice of this invention is comprised of thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylth and 2,5-bis(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the 2,5-bis(hydrocarbyldithio)-1,3,4-thiadiazoles, a number of which are available as articles of commerce. Other suitable inhibitors of copper corrosion include ether amines; polyethoxylated compounds such as ethoxylated amines, ethoxylated phenols, and ethoxylated alcohols; imidazolines; and the like.

The compositions of this invention can also optionally contain a rust inhibitor. This may be a single compound or a mixture of compounds having the property of inhibiting corrosion of ferrous metal surfaces. Such materials include oil-soluble monocarboxylic acids such as 2-ethylhexanoic acid, lauric acid, myristic acid, palmitic acid, oleic acid, linoleic acid, linolenic acid, behenic acid, cerotic acid, etc., and oil-soluble polycarboxylic acids including dimer and trimer acids, such as are produced from tall oil fatty acids, oleic acid, linoleic acid, or the like. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid, and the like; long-chain alpha, omega-dicarboxylic acids in the molecular weight range of 600 to 3000; and other similar materials. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of acidic corrosion inhibitors are the half esters of alkenyl succinic acids having 8 to 24 carbon atoms in the alkenyl group with alcohols such as the polyglycols. The corresponding half amides of such alkenyl succinic acids are also useful.

Although added in acidic form, some or all of the carboxylic groups of these carboxylic acid type corrosion inhibitors may be neutralized by excess amine present in the compositions. Other suitable corrosion inhibitors useful herein include ether amines; acid phosphates; amines; polyethoxylated compounds such as ethoxylated amines, ethoxylated phenols, ethoxylated alcohols; imidazolines; and aminosuccinic acids or derivatives thereof represented by the formula:

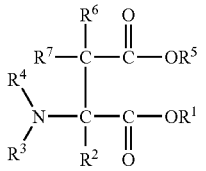

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms. The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing up to 20 carbon atoms. Most preferably, $R^1$ and $R^5$ are saturated hydrocarbon radicals containing 3-6 carbon atoms $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3-6 carbon atoms, $R^2$ is a hydrogen atom, and either $R^3$ or $R^4$ is an alkyl group containing 15-20 carbon atoms or an acyl group which is derived from a saturated or unsaturated carboxylic acid containing 2-10 carbon atoms. Most preferred of the aminosuccinic acid derivatives is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

Suitable antifoam agents for optional use in the compositions of this invention include silicones and organic polymers such as acrylate polymers. Various antifoam agents are described in Foam Control Agents by H. T. Kemer (Noyes Data Corporation, 1976, pages 125-176). Mixtures of silicone-type antifoam agents such as the liquid dialkyl silicone polymers with various other substances are also effective. Typical of such mixtures are silicones mixed with an acrylate polymer, silicones mixed with one or more amines, and silicones mixed with one or more amine carboxylates. Other such mixtures include combinations of a dimethyl silicone oil with (i) a partial fatty acid ester of a polyhydric alcohol (U.S. Pat. No. 3,235,498); (ii) an alkoxylated partial fatty acid ester of a polyhydric alcohol (U.S. Pat. No. 3,235,499); (iii) a polyalkoxylated aliphatic amine (U.S. Pat. No. 3,235,501); and (iv) an alkoxylated aliphatic acid (U.S. Pat. No. 3,235,502).

Ashless dispersants can optionally be utilized in the compositions of this invention and include carboxylic ashless dispersants, Mannich base dispersants, polymeric polyamine dispersants, and post-treated dispersants of these types. At least some of the ashless dispersant when used is preferably a boronated ashless dispersant. These are typically formed by heating the dispersant to a suitable temperature above about 100° C. with a boronating agent. Procedures suitable for effecting boronation of ashless dispersants are described for example in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

The carboxylic ashless dispersants are reaction products of an acylating agent (e.g., a monocarboxylic acid, dicarboxylic acid or other polycarboxylic acid, or derivatives thereof) with one or more polyamines and/or polyhydroxy compounds. These products are described in many patents, including British Patent 1,306,529 and the following U.S. Pat. Nos. 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,381,022; 3,399,141; 3,415,750; 3,433,744; 3,444,170; 3,448,048; 3,448,049; 3,451,933; 3,454,607; 3,467,668; 3,522,179; 3,541,012; 3,542,678; 3,574,101; 3,576,743; 3,630,904; 3,632,510; 3,632,511; 3,697,428; 3,725,441; 3,868,330; 3,948,800; 4,234,435; and Re 26,433.

There are a number of sub-categories of carboxylic ashless dispersants. One such sub-category which constitutes a preferred type is composed of the polyamine succinamides and more preferably the polyamine succinimides in which the succinic group contains a hydrocarbyl substituent, usually an alkenyl substituent, containing at least 30 carbon atoms. These dispersants are usually formed by reacting a polyamine with an alkenyl succinic acid or anhydride such as a polyisobutenyl succinic acid and anhydride wherein the polyisobutenyl group has a number average molecular weight of 500 to 5,000, preferably 700 to 2,500, and more preferably 700 to 1,400. The polyamine used in forming such compounds contains at least one primary amino group capable of forming an imide group on reaction with a hydrocarbon-substituted succinic acid or acid derivative thereof such an anhydride, lower alkyl ester, acid halide, or acid-ester. The literature is replete with descriptions of polyamines suitable for use in forming such carboxylic ashless dispersants. See for example U.S. Pat. No. 5,034,018 which describes not only simple polyamines but also amidoamine adducts which are suitable for use in forming such carboxylic ashless dispersants. Representative examples of such dispersants are given in U.S. Pat. Nos. 3,172,892; 3,202,678; 3,216,936; 3,219,666; 3,254,025; 3,272,746; 4,234,435; and 5,034,018. As used herein the term "succinimide" is meant to encompass the completed reaction product from reaction between the amine reactant(s) and the hydrocarbon-substituted carboxylic acid or anhydride (or like acid derivative) reactant(s), and is intended to encompass compounds wherein the product may have amide, amidine, and/or salt linkages in addition to the imide linkage of the type that results from the reaction of a primary amino group and an anhydride moiety.

The polymeric polyamine dispersants are polymers containing basic amine groups and oil solubilizing groups (for example, pendant alkyl groups having at least about 8 carbon atoms). Such materials include, but are not limited to, interpolymers of decyl methacrylate, vinyl decyl ether or a relatively high molecular weight olefin with aminoalkyl acrylates and aminoalkyl acrylamides. Examples of polymeric polyamine dispersants are set forth in the following patents: U.S. Pat. Nos. 3,329,658; 3,449,250; 3,493,520; 3,519,565; 3,666,730; 3,687,849; and 3,702,300.

Mannich base dispersants which can be used pursuant to this invention are condensation products formed by condensing a long chain hydrocarbon-substituted phenol with one or more aliphatic aldehydes, usually formaldehyde or a formaldehyde precursor, and one or more polyamines, usually one or more polyalkylene polyamines. Examples of Mannich condensation products, including in many cases boronated Mannich base dispersants and methods for their productions are described in the following U.S. Pat. Nos. 2,459,112; 2,962,442; 2,984,550; 3,036,003; 3,166,516; 3,236,770; 3,368,972; 3,413,347; 3,442,808; 3,448,047; 3,454,497;

3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The boron content of the gear oils of this invention can be supplied entirely by use of a boronated ashless dispersant. Alternatively the boron can be supplied in its entirety by use of one or other boron containing additive components, such as a boronated partial ester of a polyhydric alcohol which preferably is complexed with a succinimide (e.g., U.S. Pat. No. 4,455,243), by use of a finely dispersed hydrated inorganic borate (e.g., U.S. Pat. No. 3,997,454), or by use of one or more other types of suitable boron-containing additive components. The addition to the base oil of a combination of two or more different kinds of oil-soluble or dispersible boron-containing components, such as one or more boronated ashless dispersants together with a finely divided dispersed hydrated inorganic borate or a boronated partial ester of a polyhydric alcohol, is still another appropriate alternative. Preferably, at least 50 wt % and more preferably at least 75 wt % of the boron content of the compositions of this invention is introduced therein as boronated ashless dispersant. Most preferably, substantially the entire boron content, if present, of said composition (i.e., from 90 to 100% by weight of the boron content) is introduced into the compositions of this invention as one or more boronated ashless dispersants.

It should be understood that as used herein the term "ashless" in connection with the dispersants refers to the fact that they do not contain any metallic constituent other than perhaps trace amounts of metal impurities or contaminants. The term does not denote that the product must not form any residue, as the dispersants used preferably contain either or both of boron and phosphorus. Although these elements are not metals, small amounts of deposits or residues can result from the presence of these elements in the dispersant.

As noted above, the compositions of this invention are essentially metal-free and essentially halogen-free. By this is meant that if any metal-containing additive component is employed, it is employed in an amount such that the finished gear oil contains by weight a total of no more than 500 ppm of metal introduced by way of added metal-containing additive(s), and that if any halogen-containing additive component is employed, it is employed in an amount such that the finished gear oil contains by weight a total of no more than 300 ppm of halogen introduced by way of added metal-containing additive(s). Preferably, no metal-containing additive is used. Typically there may be trace amounts of chlorine in the finished gear oil introduced as an impurity in one or more of the additive components. For example, succinic derivative ashless dispersants wherein in the formation of the succinic acylating agent such as polyisobutenyl succinic anhydride it is common to react the polyisobutene with chlorine to enhance the reaction with maleic anhydride. Thus the finished product in which such dispersants are used is likely to contain small amounts of chlorine. Likewise, certain organic sulfur antiwear and/or extreme pressure agents can contain small amounts of residual chlorine if chlorine-containing reagents are used in their manufacture. Such residual amounts of chlorine can be carried over into the finished ashless dispersant and thus introduced into the finished gear lubricant in this manner.

Preferably however, deliberate use of halogenated additives in order to utilize their halogen content (e.g., for antiwear or extreme pressure performance) is avoided in the practice of this invention. Preferred finished gear oils of this invention utilize components proportioned such that the kinematic viscosity of the composition at 100° C. is at least about 12 cSt and the preferred Brookfield viscosity of the composition is less than about 150,000 cP at −40° C. and most preferred if the Brookfield is less than about 150,000 cP at −26° C. Also preferred are compositions characterized in that the sulfur-containing antiwear and/or extreme pressure agent is selected from sulfurized olefinic hydrocarbon, aliphatic polysulfides, and mixtures of sulfurized olefinic hydrocarbon and aliphatic polysulfides; in that the ashless dispersant consists essentially of at least one succinic derivative ashless dispersant selected from boronated alkenyl succinimides, boronated alkenyl succinic esters, and boronated alkenyl succinic ester-amides; and in that the entire boron content, if any, of the composition is introduced therein as the succinic derivative ashless dispersant; and in that the composition is devoid of any metal-containing additive.

The following examples in which parts and percentages are by weight illustrate the practice of this invention. These examples are not intended to limit, do not limit, and should not be construed as limiting the generic aspects of this invention in any manner whatsoever.

EXAMPLES

The components of the blends of the inventive gear oils are included in Table 1.

TABLE 1

| | Sample | | | | | |
|---|---|---|---|---|---|---|
| Antiwear | A | B | C | D | E | F |
| dithio phosphate ester | Y | Y | Y | Y | Y | Y |
| thio phosphate salt | | | Y | Y | Y | Y |
| di-alkyl phosphite | Y | | | | | |
| Acid Phosphate salt | Y | Y | Y | Y | | |
| EP additive | SIB | SIB | di-t-butyl polysulfide | trisulfide | di-t-butyl polysulfide | trisulfide |
| Sulfur Activity of EP | 55 | 55 | 126 | 4 | 126 | 4 |
| Metal detergent | None | None | None | None | None | None |
| % S from package | 1.5 | 1.5 | 1.4 | 1.4 | 1.4 | 1.4 |

TABLE 1-continued

| | Sample | | | | | |
|---|---|---|---|---|---|---|
| Antiwear | A | B | C | D | E | F |
| % P from package | 0.13 | 0.19 | 0.14 | 0.14 | 0.13 | 0.13 |

The performance summary of the gear oil blends is provided in Table 2.

TABLE 2

| Performance Summary | A | B | C | D | E | F |
|---|---|---|---|---|---|---|
| HT Axle Fatigue Test | Fail | Fail | Pass | Fail | Pass | Pass |
| HT Axle EOT Wear | 2800 ppm | 2700 ppm | 210 ppm | 170 ppm | 180 ppm | 130 ppm |
| HT Bearing Test | Pass | Pass | Pass | Pass | Pass | Pass |
| L-42 Axle Shock test | Fail | Fail | Pass | Fail | Pass | Fail |
| ISOT Cu Wt Loss | 38% | 30% | 9% | 19% | 11% | Est 19% |
| EP additive | SIB | SIB | di-t-butyl polysulfide | di-t-butyl trisulfide | di-t-butyl polysulfide | di-t-butyl trisulfide |
| CCT wt loss (mg) | 55 | 55 | 126 | 4 | 126 | 4 |
| | | | | | Preferred | |

The Copper Corrosion Weight Loss of various EP additive are provided in Table 3.

TABLE 3

| EP | CCT |
|---|---|
| SIB | 55 |
| Di-t-butyl polysulfide | 126 |
| Di-t-butyl disulfide | 2 |
| Di-t-butyl trisulfide | 4 |
| Di-t-butyl pentasulfide | 466 |
| Di-t-nonyl polysulfide | 731 |

The Copper Corrosion Weight Loss (CCT) Test Procedure is described below.

Scope

This method is used to determine the activity of the available sulfur in EP additives as measured by its corrosiveness to copper.

Summary of Method

A weighed copper strip immersed in EP additive is heated three hours at 121.1° C. (250° F.). The corrosion scale is removed using 10% potassium cyanide solution and the weight loss (in mg) is determined.

Procedure

A new copper strip is weighed to the nearest 0.1 mg. The weighed strip is then placed into a test tube and covered with 35±0.1 g of material to be tested. The tube and contents is placed in the oil bath and immersed for exactly 180±5 minutes (3 hours±5 minutes). The strip is then removed with forceps and allowed to cool. The copper strip is washed with heptane and it is let to dry. Using forceps, the strip is placed into a plastic bottle of cyanide solution and the contents are swirled for a few moments. The strip should remain in cyanide solution for not more than five minutes. With forceps, the strip is removed and flushed in running water under the faucet. The strip is dried with acetone and the remaining loose deposits are rubbed off with a towel moistened with heptane. Finally, the dried strip is weighed and the weight loss is determined. CCT=(total weight loss) mg.

We claim:

1. A gear oil composition comprising the following components:

Component A: a base oil having a kinematic viscosity at 100° C. of about 4 to about 32 cSt;

Component B: a di-t-butyl tri-sulfide, di-t-butyl tetra-sulfide, and di-t-butyl penta-sulfide mixture having a sulfur activity of greater than about 125 mg in the Copper Corrosion Test;

Component C: a dihydrocarbyl dithiophosphate ester or salt; and

Component D: a dihydrocarbyl (mono)thiophosphate amine salt.

2. The gear oil of claim 1, wherein Component B comprises less than about 3.5 percent by weight of the gear oil.

3. A gear oil composition comprising the following components:

Component A: a base oil having a kinematic viscosity at 100° C. of about 4 to about 32 cSt;

Component B: a di-t-butyl tri-sulfide, di-t-butyl tetra-sulfide, and di-t-butyl penta-sulfide mixture having a sulfur activity of greater than about 125 mg in the Copper Corrosion Test;

Component C: the product of the mixture of dicyclopentadiene and dialkyldithiophosphoric acid, wherein the weight percentage of Component C is about 0.1 to about 6.0 percent of the oil; and Component D: a dihydrocarbyl (mono)thiophosphate amine salt.

4. The gear oil of claim 1, wherein Component D is essentially free of phosphites.

5. The gear oil of claim 1, wherein Component D comprises the product of the mixture of dibutylhydrogen phosphite, sulfur and at least one amine.

6. The gear oil of claim 4, wherein the weight percentage of Component D is about 0.01 to about 1.0 percent of the oil.

7. The gear oil of claim 1 further comprising at least one of:

a copper corrosion inhibitor, a rust inhibitor and an anti-foam agent.

8. The gear oil of claim 1 further comprising:

a boronated ashless dispersant.

9. The gear oil of claim 8 wherein said dispersant is a succinimide.

10. The gear oil of claim 8 wherein said dispersant is a Mannich base dispersant.

* * * * *